US010438540B2

(12) United States Patent
Yang et al.

(10) Patent No.: US 10,438,540 B2
(45) Date of Patent: Oct. 8, 2019

(54) CONTROL CIRCUITRY FOR ELECTRONIC DEVICE DISPLAYS

(71) Applicant: Apple Inc., Cupertino, CA (US)

(72) Inventors: Shyuan Yang, Burlingame, CA (US); Abbas Jamshidi Roudbari, San Jose, CA (US); Ting-Kuo Chang, San Jose, CA (US); Tsung-Ting Tsai, Cupertino, CA (US); Warren S. Rieutort-Louis, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 81 days.

(21) Appl. No.: 15/701,342

(22) Filed: Sep. 11, 2017

(65) Prior Publication Data

US 2018/0366065 A1 Dec. 20, 2018

Related U.S. Application Data

(60) Provisional application No. 62/522,595, filed on Jun. 20, 2017.

(51) Int. Cl.

*G09G 3/3266* (2016.01)
*G09G 3/3225* (2016.01)
*G09G 3/20* (2006.01)

(52) U.S. Cl.

CPC ..... *G09G 3/3266* (2013.01); *G09G 3/20* (2013.01); *G09G 3/3225* (2013.01); *G09G 2310/0283* (2013.01)

(58) Field of Classification Search

CPC ..... G09G 3/3266; G09G 3/3225
USPC ..... 345/76, 98, 214; 348/5
See application file for complete search history.

(56) References Cited

U.S. PATENT DOCUMENTS 8,994,631 B2 * 3/2015 Chun ..... G09G 3/2011 345/89
2002/0097402 A1 * 7/2002 Manning ..... G01J 3/453 356/451
2005/0068270 A1 * 3/2005 Awakura ..... G09G 3/3208 345/76
2006/0038752 A1 * 2/2006 Winters ..... G09G 3/3225 345/76
2007/0146354 A1 * 6/2007 Kubota ..... G09G 3/2011 345/204
2007/0188423 A1 * 8/2007 Kasai ..... G09G 3/3225 345/76
2008/0001189 A1 * 1/2008 Jong ..... H01L 29/0653 257/288

(Continued)

*Primary Examiner* — Prabodh M Dharia
(74) *Attorney, Agent, or Firm* — Kilpatrick Townsend & Stockton

(57) ABSTRACT

Aspects of the subject technology relate to display circuitry. The display circuitry includes gate-in-panel (GIP) control circuitry on opposing sides of a display pixel array. The GIP control circuitry can include scan drivers for each pixel row on both sides of that pixel row, the scan drivers on either side configured for enablement or disablement for single-sided reduced-power operations. The GIP control circuitry can include a single scan driver and a single emission controller for each pixel row, in which the scan driver and emission controller for each row are disposed on opposing sides of the row. The scan drivers for a first subset of the pixel rows can be interleaved with the emission controllers for a different subset of the pixel rows.

21 Claims, 11 Drawing Sheets

(56) References Cited

U.S. PATENT DOCUMENTS

| | | | | |
|---|---|---|---|---|
| 2008/0136765 | A1* | 6/2008 | Neugebauer | G02F 1/13624 345/98 |
| 2011/0249209 | A1* | 10/2011 | Ko | G09G 3/3648 349/41 |
| 2013/0002616 | A1* | 1/2013 | Kim | H01L 29/78615 345/204 |
| 2013/0099692 | A1* | 4/2013 | Chaji | H05B 37/02 315/224 |
| 2013/0257837 | A1* | 10/2013 | Wang | G09G 3/3696 345/211 |
| 2013/0345391 | A1* | 12/2013 | Knutson | G01N 21/6428 530/300 |
| 2014/0118623 | A1* | 5/2014 | Bushell | G09G 3/3666 348/705 |
| 2017/0003811 | A1* | 1/2017 | Lu | G06F 3/0416 |
| 2017/0060317 | A1* | 3/2017 | Kim | G06F 3/0416 |
| 2017/0192580 | A1* | 7/2017 | Jung | G06F 3/0416 |
| 2018/0212051 | A1* | 7/2018 | Wu | H01L 51/0097 |
| 2019/0004655 | A1* | 1/2019 | Kim | G06F 3/0412 |

* cited by examiner

CONTROL CIRCUITRY FOR ELECTRONIC DEVICE DISPLAYS

CROSS-REFERENCE TO RELATED APPLICATIONS

The present application claims the benefit of U.S. Provisional Patent Application Ser. No. 62/522,595 entitled "CONTROL CIRCUITRY FOR ELECTRONIC DEVICE DISPLAYS," filed on Jun. 20, 2017, which is hereby incorporated by reference in its entirety for all purposes.

TECHNICAL FIELD

The present description relates generally to electronic device displays, and more particularly, but not exclusively, to gate-in-panel displays.

BACKGROUND

Electronic devices such as computers, media players, cellular telephones, set-top boxes, and other electronic equipment are often provided with displays for displaying visual information. Displays such as organic light-emitting diode (OLED) displays and liquid crystal displays (LCDs) typically include an array of display pixels arranged in pixel rows and pixel columns. Control circuitry for displays is sometimes disposed in an inactive area surrounding an active area in which active display pixels are disposed.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
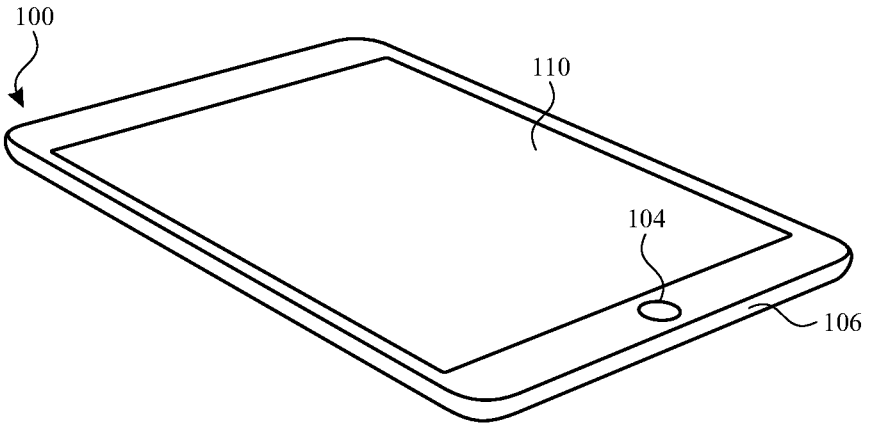
FIG. 1 illustrates a perspective view of an example electronic device having a display in accordance with various aspects of the subject technology.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject disclosure provides control circuitry for electronic device displays such as organic light-emitting diode (OLED) displays (e.g., active matrix OLED or AMOLED displays), liquid crystal displays (LCDs), plasma displays, or displays based on other display technologies. In accordance with various aspects, the electronic device displays are gate-in-panel (GIP) displays in which control circuitry for operating the pixels of the display is disposed on the same substrate (panel) on which the pixels are formed (e.g., using thin-film transistor components on the substrate).

Various examples are described herein in the context of AMOLED displays with GIP. However, this is merely illustrative and the concepts described herein may be applied to other types of OLED displays. OLED displays such as AMOLED displays with GIP may be included in electronic devices such as cellular telephones, media players, computers, set-top boxes, wireless access points, and other electronic equipment that may include displays. Displays are used to present visual information and status data and/or may be used to gather user input data. A display includes an array of display pixels. The array of display pixels is disposed in an active area of the display. The array of display pixels is arranged in pixel rows and pixel columns. Each display pixel may include one or more colored subpixels for displaying color images.

Control circuitry for operating the display pixels is disposed in an inactive area of the display. The inactive area of the display may include portions of the display disposed to the left of the active area, to the right of the active area, at the top of the active area, or at the bottom of the active area. In OLED displays in particular, the control circuitry in the inactive area includes one or more scan drivers and one or more emission controllers for each pixel row. Each display pixel may include a light-emitting diode. The scan driver(s) for each pixel row is operated to activate the pixels in that pixel row. The emission controller(s) for each pixel row is operated to control the amount of light generated by each pixel in that pixel row.

In some implementations, both a scan driver and an emission controller are provided on both sides of each pixel row. In some implementations and in some operational scenarios, the control circuitry may include a control line for selectively enabling and disabling the scan drivers on one and/or the other side of the pixel rows. In this way, power consumption by the display can be reduced in these operational scenarios. This reduction in power consumption facilitates continuously providing some information on the display (e.g., a clock, date, background image, or other information) even when the device in which the display is disposed is in a low power, sleep, or hibernate mode.

In some implementations, the control circuitry includes a single scan driver for each row, disposed on a first side of that row, and a single emission controller for that row, provided on an opposing second side of that row. In these implementations, the scan drivers for some of the pixel rows are located in the inactive area on a first side of the array and the scan drivers for other pixel rows may be located on an opposing second side of the array. In these implementations, the emission controllers for some of the pixel rows are located in the inactive area on the first side of the array and the emission controllers for other pixel rows may be located on the opposing second side of the array.

The scan drivers for a first set of pixel rows may be interleaved, on a first side of the array, with the emission controllers for a second set of pixel rows. The scan drivers for the second set of pixel rows may be interleaved, on an opposing second side of the array, with the emission controllers for the first set of pixel rows. The interleaving of the scan drivers and the emission controllers on each side of the array may be an every-other row interleaving, an every two rows interleaving, or may include another regular or irregular interleaving pattern. Providing an interleaved arrangement in which only one of the scan driver or the emission controller for each row is disposed on a given side of that row can help reduce the size of the inactive area while reducing display non-uniformities relative to, for example, a single-sided GIP driver.

An illustrative electronic device having a display is shown in FIG. 1. In the example of FIG. 1, device 100 has been implemented using a housing that is sufficiently small to be portable and carried by a user (e.g., device 100 of FIG. 1 may be a handheld electronic device such as a tablet computer or a cellular telephone). As shown in FIG. 1, device 100 includes a display such as display 110 mounted on the front of housing 106. Display 110 may be a gate-in-panel (GIP) display that includes active display pixels in an active area (AA) of the display and control circuitry for operating the active display pixels an inactive portion. Display 110 may have openings (e.g., openings in the inactive or active portions of display 110) such as an opening to accommodate button 104 and/or other openings such as an opening to accommodate a speaker, a light source, or a camera.

Display 110 may be a touch screen that incorporates capacitive touch electrodes or other touch sensor components or may be a display that is not touch-sensitive. Display 110 includes display pixels formed from light-emitting diodes (LEDs), organic light-emitting diodes (OLEDs), plasma cells, electrophoretic display elements, electrowetting display elements, liquid crystal display (LCD) components, or other suitable display pixel structures. Arrangements in which display 110 is formed using OLED display pixels and GIP control circuitry are sometimes described herein as an example. This is, however, merely illustrative. In various implementations, any suitable type of display pixel technology may be used in forming display 110 if desired.

Housing 106, which may sometimes be referred to as a case, may be formed of plastic, glass, ceramics, fiber composites, metal (e.g., stainless steel, aluminum, etc.), other suitable materials, or a combination of any two or more of these materials.

The configuration of electronic device 100 of FIG. 1 is merely illustrative. In other implementations, electronic device 100 may be a computer such as a computer that is integrated into a display such as a computer monitor, a laptop computer, a somewhat smaller portable device such as a wrist-watch device, a pendant device, or other wearable or miniature device, a media player, a gaming device, a navigation device, a computer monitor, a television, or other electronic equipment.

For example, in some implementations, housing 106 may be formed using a unibody configuration in which some or all of housing 106 is machined or molded as a single structure or may be formed using multiple structures (e.g., an internal frame structure, one or more structures that form exterior housing surfaces, etc.). Although housing 106 of FIG. 1 is shown as a single structure, housing 106 may have multiple parts. For example, housing 106 may have upper portion and lower portion coupled to the upper portion using a hinge that allows the upper portion to rotate about a rotational axis relative to the lower portion. A keyboard such as a QWERTY keyboard and a touch pad may be mounted in the lower housing portion, in some implementations.

In some implementations, electronic device 100 is provided in the form of a computer integrated into a computer monitor. Display 110 may be mounted on a front surface of housing 106 and a stand may be provided to support housing (e.g., on a desktop).

Figure 2:
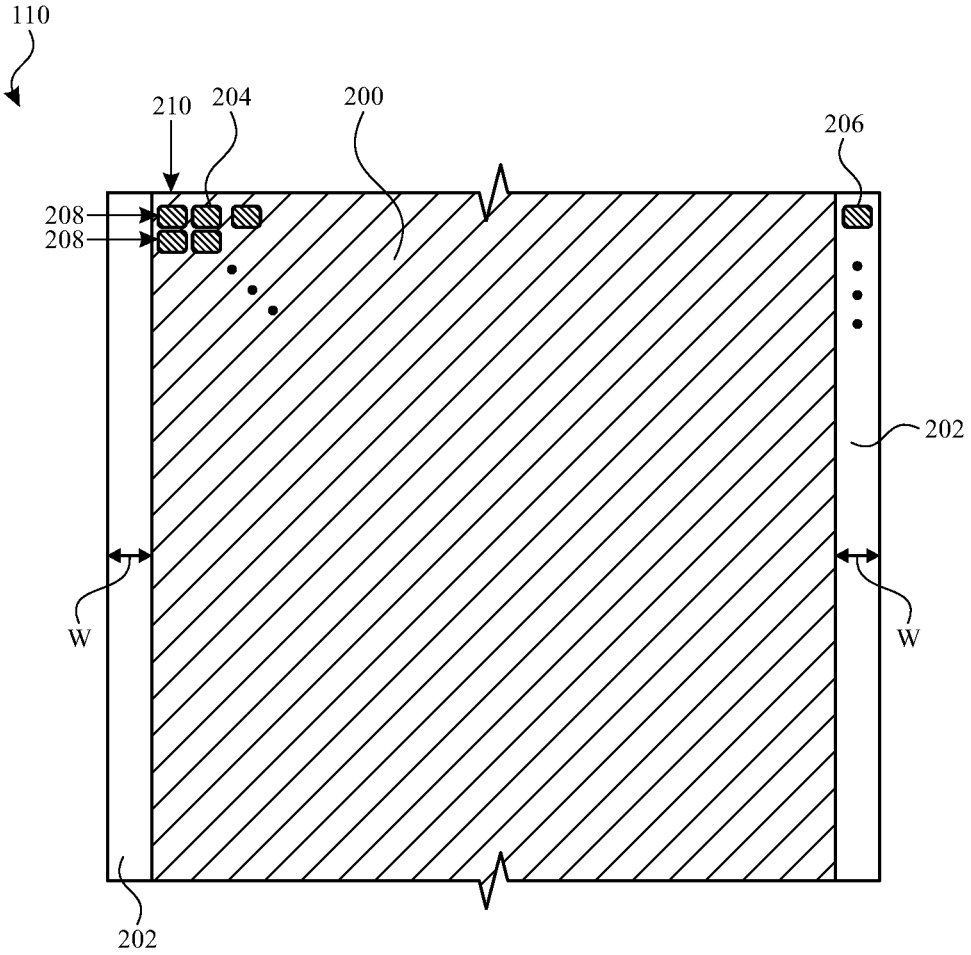
FIG. 2 illustrates a schematic diagram of a top view of an electronic device display in accordance with various aspects of the subject technology.

FIG. 2 is a schematic diagram of a portion of display 110 showing how display 110 has an active area 200 and an inactive area 202, which may be formed on a common substrate or panel. In the example of FIG. 2, the inactive area 202 includes portions on the left and right sides of active area 200. Active area 200 includes an array of display pixels 204 that generate patterns of light (e.g., colored light) for displaying text, images, video, and/or other content. As shown, display pixels 204 are arranged in an array that includes pixel rows 208 and pixel columns 210.

Inactive area 202 includes control circuitry 206 for operating pixels 204 in each pixel row 208. Control circuitry 206 includes row control circuitry for operating pixel rows 208 and may be complementary to, and co-operable with, column control circuitry such as one or more data drivers and a plurality of data lines that provide data signals to the display pixels in each column 210.

Inactive area 202 has a width W. The width W may be sufficient to accommodate both a scan driver and an emission controller for each pixel row 208 on each side of active area 200 or may be a reduced width that accommodates only one of a scan driver or an emission controller on a particular side of each pixel row.

Figure 3:
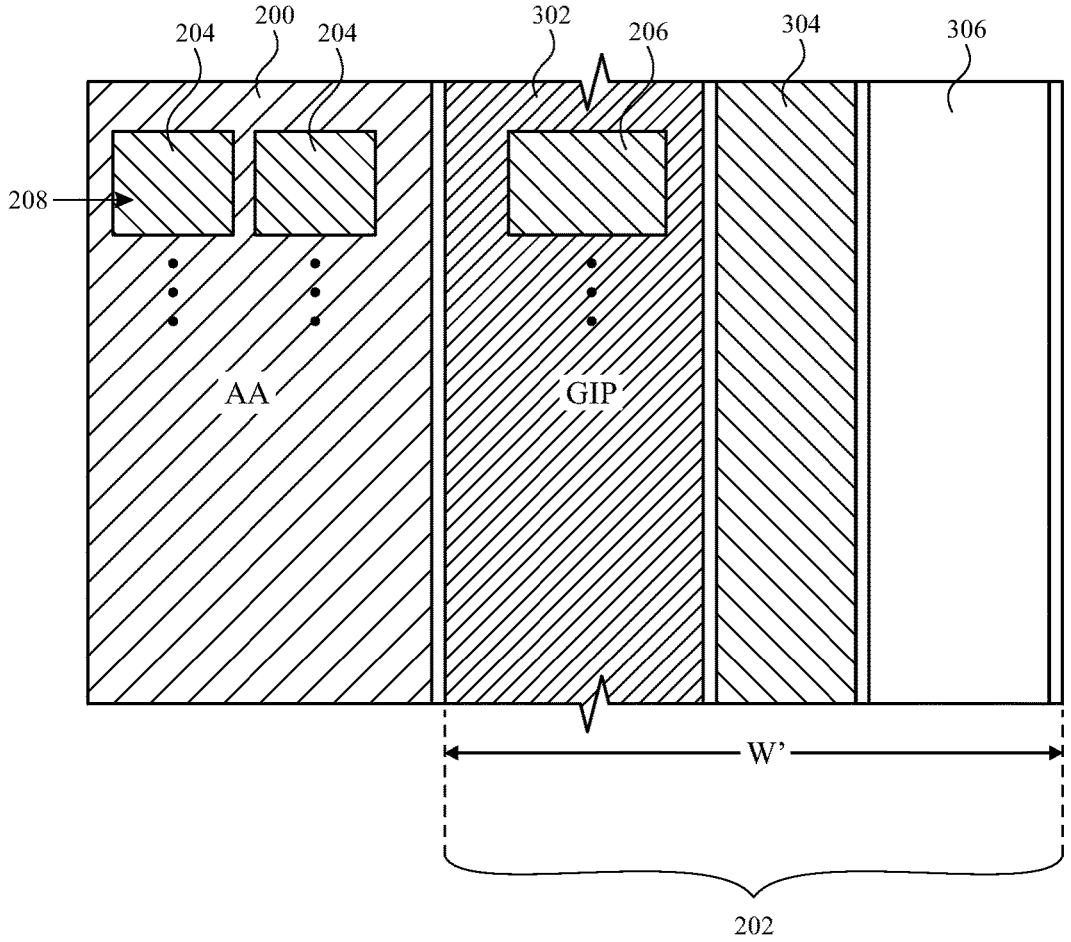
FIG. 3 illustrates a schematic diagram of a portion of the electronic device display of FIG. 2 display in accordance with various aspects of the subject technology.

FIG. 3 shows an enlarged view of a portion of display 110 of FIG. 2. As shown in FIG. 3, inactive area 202 includes a GIP portion 302 and may also include a power supply portion 304, and a border region 306. Border region 306 may be an encapsulation region at the edge of the display. Power supply portion 304 may include one or more power lines for supplying power to control circuitry 206 and/or to pixels 204. In accordance with some aspects of the subject disclosure (see, e.g., FIGS. 10-16 and the associated description below), the width W of inactive area 202 may be reduced by providing scan drivers and emission controllers for each pixel row 208 only on a single side of active area 200.

Figure 4:
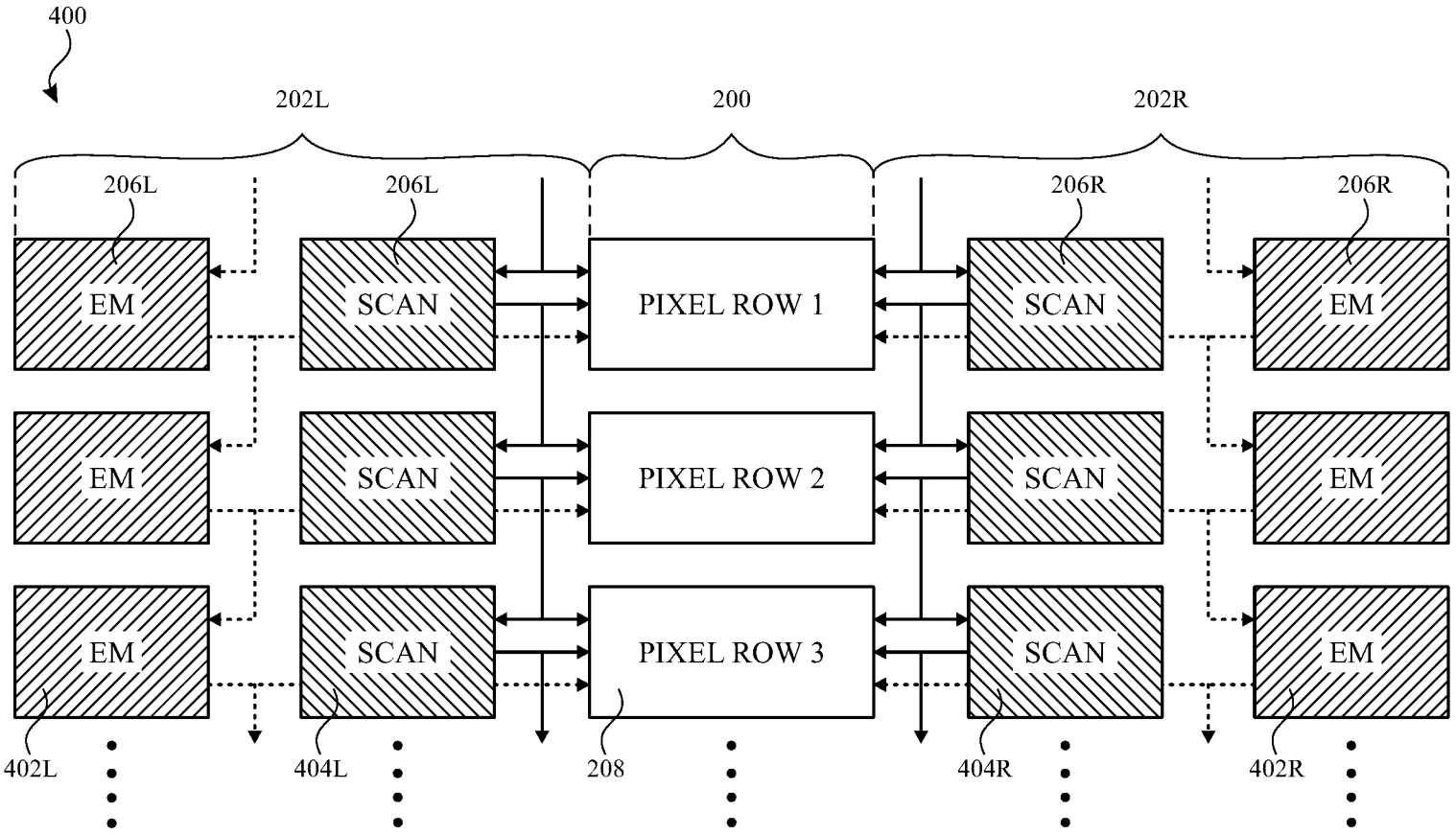
FIG. 4 illustrates a schematic diagram of control circuitry for pixel rows of an electronic device display in accordance with various aspects of the subject technology.

However, in some implementations such as in the examples of FIGS. 4-9 which will now be described, each pixel row 208 has an associated scan driver and an associated emission controller on both sides of that row. FIG. 4 shows a block diagram of exemplary display circuitry 400 that includes a scan driver and an emission controller on both sides of each pixel row.

As shown in FIG. 4, pixels in each pixel row 208 are controlled using multiple signals generated by control circuitry 206L and 206R on opposing sides of active area 200, the control circuitry including multiple GIP drivers for each pixel row. In the example of FIG. 4, GIP circuits 206L and 206R for each row are provided in inactive areas 202L and 202R on both sides of the active area 200 of the panel for head-to-head double side drive of the pixels.

Each GIP driver 206L and 206R includes a scan driver and an emission controller. More specifically, a first GIP driver 206L on a first (e.g., left) side of each row 208 includes a first emission controller 402L and a first scan driver 404L that respectively provide emission (EM) control signals and scan (SCAN) or gate signals to the pixels in that row. A second GIP driver 206R is provided on a second (e.g., right) side of each row 208 and includes a second emission controller 402L and a second scan driver 404L that respectively provide emission (EM) control signals and scan (SCAN) or gate signals to the pixels in that same row.

The double-sided drive arrangement of FIG. 4 can be beneficial for display performance. However, in some scenarios, it can be useful to reduce the amount of power used by display 110, particularly when display 110 is being operated while device 100 is in a low-power operating mode.

Figure 5:
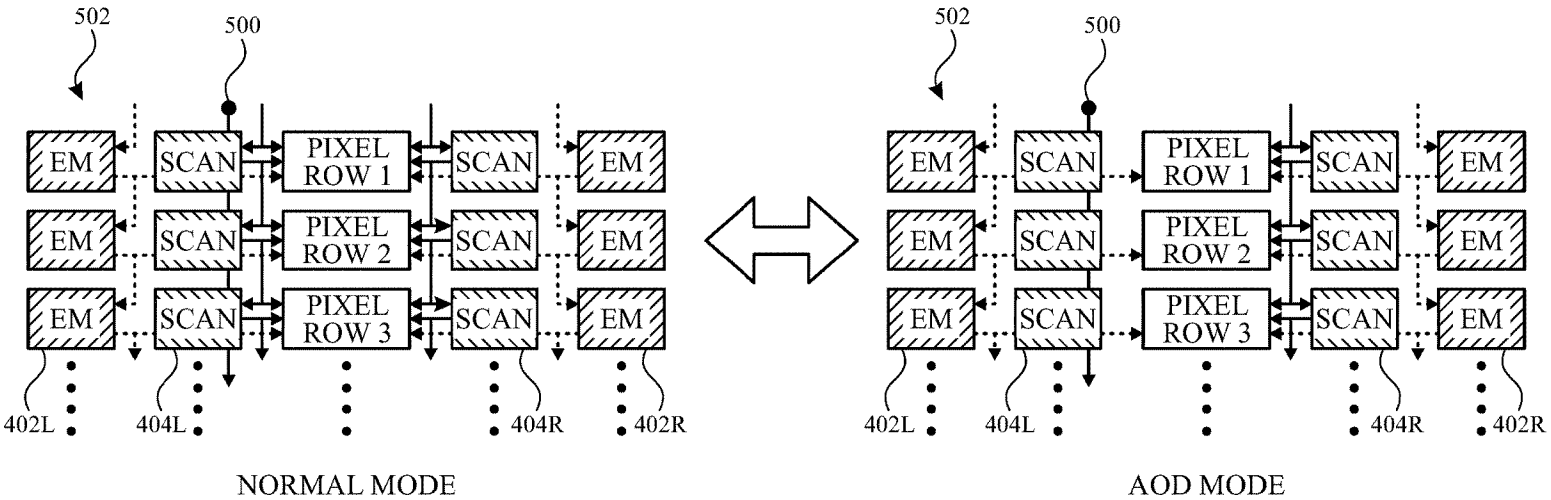
FIG. 5 illustrates schematic diagrams of control circuitry for pixel rows of an electronic device display having a control line for selectively enabling and disabling the control circuitry on one side of an active area of the display, in various modes of operation, in accordance with various aspects of the subject technology.

FIG. 5 shows another example of display circuitry 502 for display 110 that can provide a reduced-power operating mode for the display. In the example of FIG. 5, a control line 500 is provided for the scan drivers 404L on the first side of the display. As shown, enable/disable signals (e.g., an enable signal or a disable signal, the enable/disable signal sometimes referred to herein as AOD EN for convenience) are provided along control line 500 to scan drivers 404L to switch between head-to-head (double-sided) driving for a normal mode of operation for display 110 and single-side driving for a reduced-power (AOD) mode for display 110. For example, an enable signal may be provided to scan drivers 404L to enable scan drivers 404L so that pixel rows 208 are driven by scan drivers 404L and emission controllers 402L, and scan drivers 404R and emission controllers 402R, in a head-to-head (double-sided) driving mode as shown at the left of FIG. 5. To switch to the AOD mode at the right of FIG. 5, a disable signal is provided to scan drivers 404L to disable scan drivers 404L so that pixel rows 208 are driven only by scan drivers 404R and emission controllers 402R in a reduced-power mode.

Figure 6:
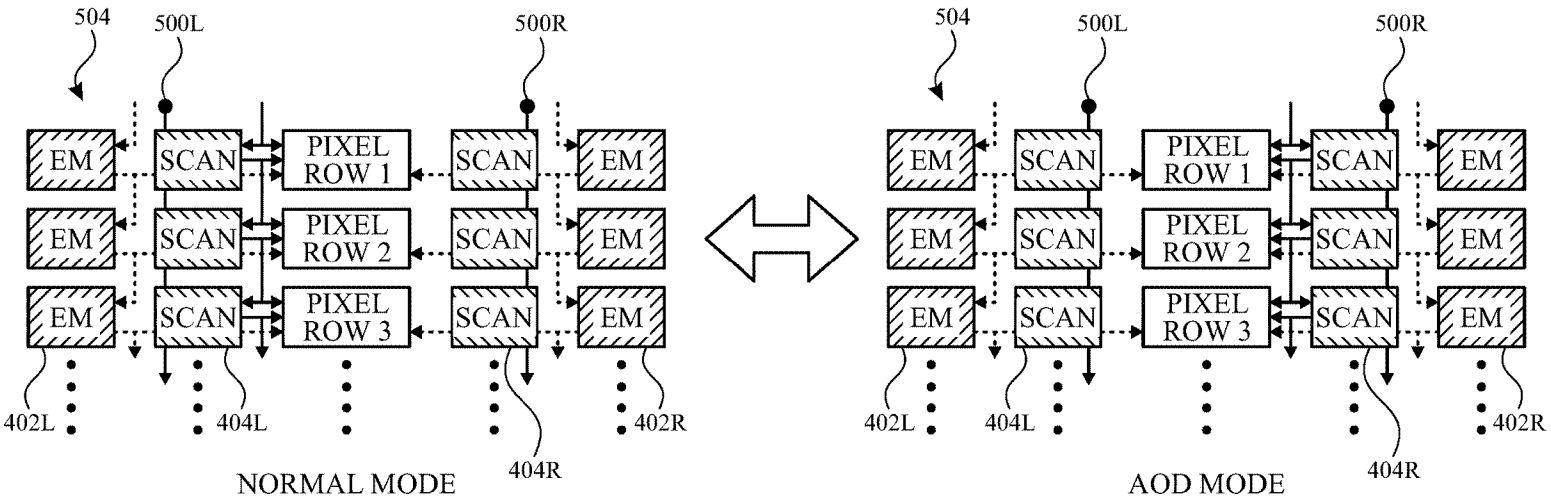
FIG. 6 illustrates a schematic diagram of control circuitry for pixel rows of an electronic device display having control lines for selectively enabling and disabling the control circuitry on both sides of an active area of the display, in various modes of operation, in accordance with various aspects of the subject technology.

FIG. 6 shows another example of display circuitry 504 for display 110 that can provide a reduced-power operating mode for the display. In the example of FIG. 6, a control line 500L is provided for the scan drivers 404L on the first side of the display and a control line 500R is provided for the scan drivers 404R on the second side of the display. In a configuration with enable/disable control lines 500L and 500R on both sides of pixel rows 208, alternating or interlaced driving of pixel rows 208 may be performed.

In the example of FIG. 6, alternating driving of pixel rows 208 during operation of display 110 in a reduced-power (AOD) mode is illustrated. As shown at the left of FIG. 6, during a first portion of a reduced-power operating mode (or during a first reduced-power operating mode), an enable signal is provided to scan drivers 404L to enable scan drivers 404L while a disable signal is provided to scan drivers 404R to disable scan drivers 404R. In this way, pixel rows 208 are driven by scan drivers 404L and emission controllers 402L on the first (e.g., left) side of the pixel rows. During another portion of the reduced-power operating mode (or during a separate, second, reduced-power operating mode), an enable signal is provided to scan drivers 404R to enable scan drivers 404R while a disable signal is provided to scan drivers 404L to disable scan drivers 404L (as shown at the right of FIG. 6). In this way, pixel rows 208 are driven by scan drivers 404R and emission controllers 402R on the second (e.g., right) side of the pixel rows.

The arrangement of FIG. 6 may allow single-side driving of pixel rows 208 in an alternating matter that avoids overuse and wear of the transistors on any one side of the display. The enable/disable signals AOD EN may be provided to scan drivers 404L and 404R in an alternating manner that alternates with each different occurrence of a reduced-power display mode, with a fixed period within each reduced-power display mode, following a predetermined number of display refreshes, with each refresh of the display, or based on the content displayed during the reduced-power display mode. The reduced-power display mode may be used to display information (e.g., text, images, etc.) on the display when device 100 is in a low-power (e.g., sleep or hibernation) state.

Figure 7:
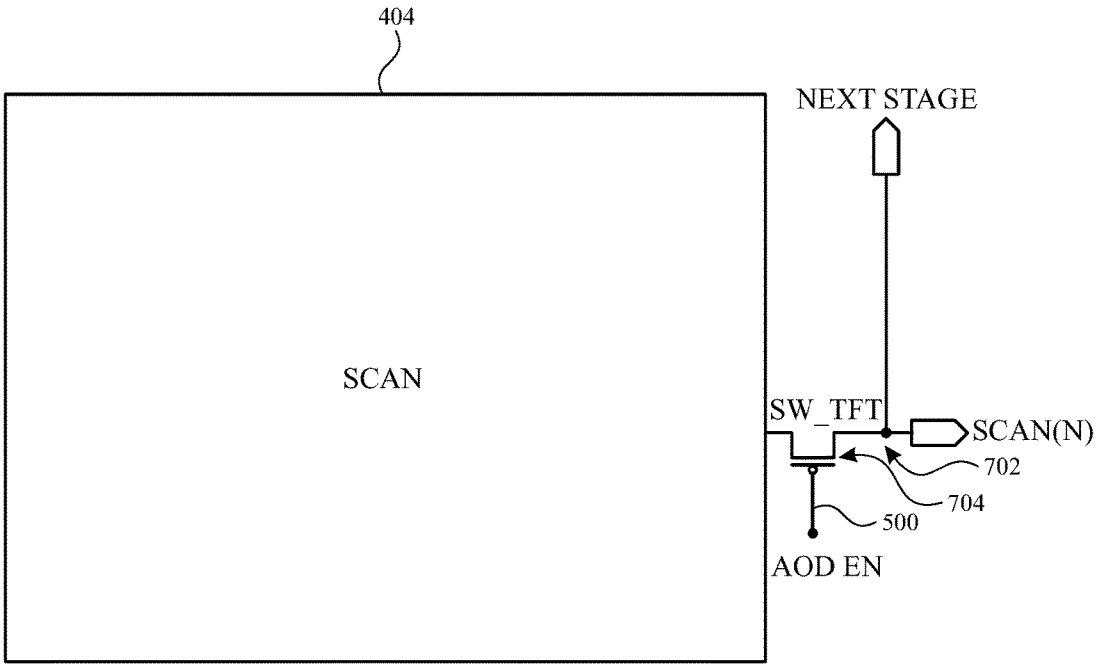
FIG. 7 illustrates an exemplary scan driver circuit coupled to a control line for selectively enabling and disabling the scan driver, in various modes of operation, in accordance with various aspects of the subject technology.
Figure 8:
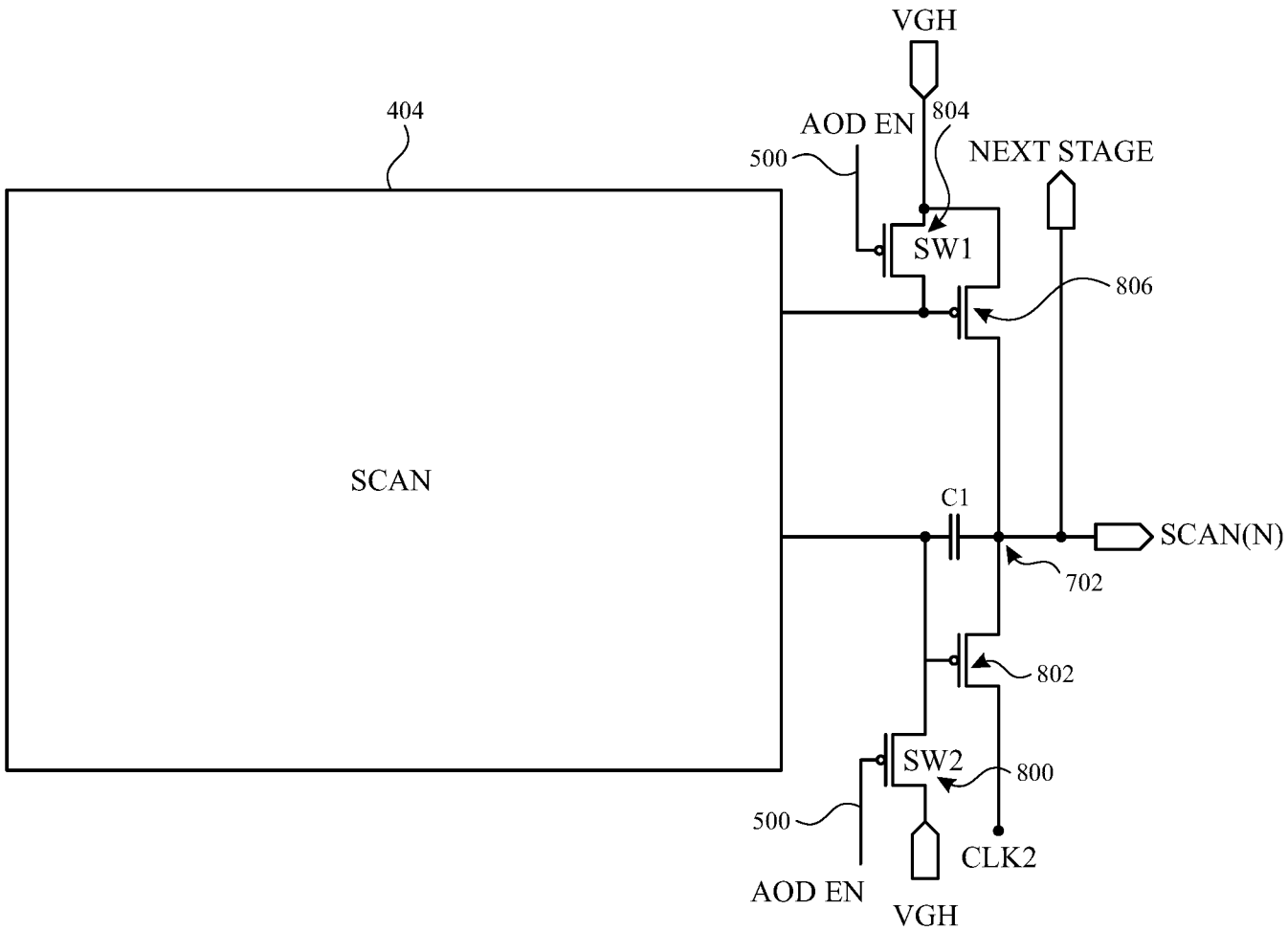
FIG. 8 illustrates another exemplary scan driver circuit coupled to a control line for selectively enabling and disabling the scan driver, in various modes of operation, in accordance with various aspects of the subject technology.

FIGS. 7 and 8 show two exemplary scan driver circuits configured to be enabled and disabled by an enable/disable signal AOD EN. For example, FIG. 7 shows a scan driver 404 that includes an output line 702 and a switch 704 that is operable based on an enable/disable signal AOD EN from control line 500. In the example of FIG. 7, the enable/disable signal AOD EN is provided to the gate terminal of a transistor 704 that is disposed on output line 702 of the scan driver. Output line 702 may be used to provide the scan or gate signal to the pixels of an associated pixel row 208 when scan driver 404 is enabled. Scan driver 404 of FIG. 7 may be an implementation of any of scan drivers 404, 404L, or 404R of FIGS. 4-6. Various configurations of a GIP scan driver may be used to implement the remaining circuitry of scan driver 404 as would be understood by one of ordinary skill in the art. The AOD EN signal is switchable between (i) an enable signal that turns transistor 704 on to enable scan driver 404 (e.g., to enable single side-drive using scan driver 404 for the reduced-power (AOD) mode or to enable double-sided drive) or (ii) a disable signal that turns transistor 704 off to disable scan driver 404 (e.g., to enable single side-drive using another scan driver 404 on an opposing side of the associated pixel row for the reduced-power (AOD) mode).

In the example of FIG. 8, the enable/disable signal AOD EN is provided to multiple internal transistors within the scan driver. As shown, in some exemplary implementations, scan driver 404 is provided with enable/disable control transistors 800 and 804. Each of enable/disable control transistors 800 and 804 receive the enable/disable signal AOD EN at a respective gate terminal. As shown, enable/disable control transistor 800 is arranged to turn on and off a transistor 802 having a first source/drain terminal configured to receive a clock signal and a second source drain terminal coupled to output line 702. As shown, enable/disable control transistor 804 is arranged to turn on and off a transistor 806 having a first source/drain terminal configured to receive a high gate voltage (VGH) and a second source drain terminal coupled to output line 702 and the second source/drain terminal of transistor 802. Accordingly, the AOD EN signal turns transistors 802 and 806 on and off to enable and disable single-side drive for the reduced-power (AOD) mode.

Figure 9:
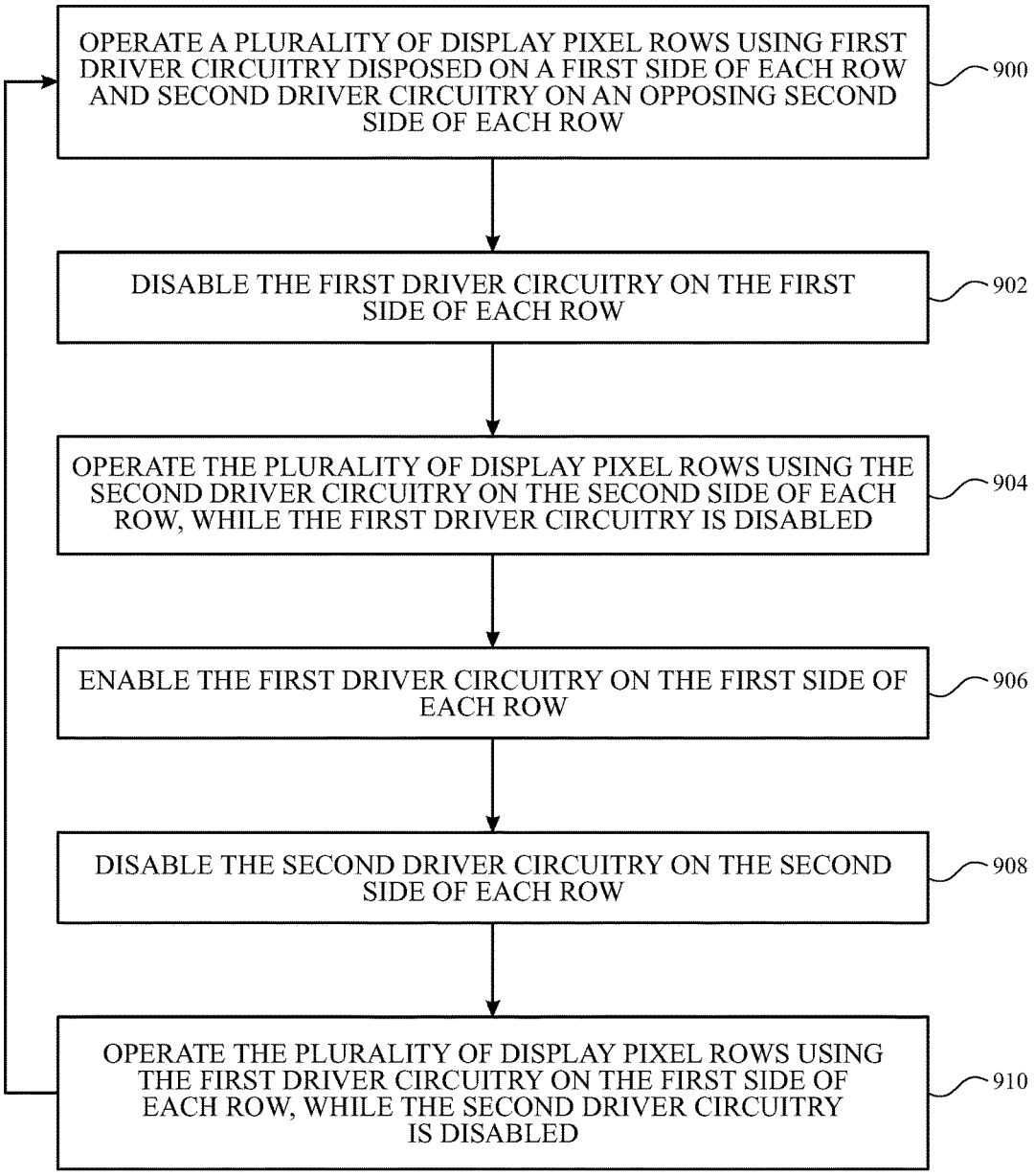
FIG. 9 illustrates a flow chart of an example process for reduced-power operation of an electronic device display in accordance with various aspects of the subject technology.

FIG. 9 depicts a flow diagram of an example process for operating a display such as an AMOLED display with GIP in a normal operating mode and in a reduced-power operating mode in accordance with various aspects of the subject technology. For explanatory purposes, the example process of FIG. 9 is described herein with reference to the components of FIGS. 1-8. Further for explanatory purposes, the blocks of the example process of FIG. 9 are described herein as occurring in series, or linearly. However, multiple blocks of the example process of FIG. 9 may occur in parallel. In addition, the blocks of the example process of FIG. 9 need not be performed in the order shown and/or one or more of the blocks of the example process of FIG. 9 need not be performed.

In the depicted example flow diagram, at block 900, a plurality of display pixel rows such as pixel rows 208 are operated using first driver circuitry disposed on a first side of each row and second driver circuitry on an opposing second side of each row. The first driver circuitry may, for example, include a scan driver 404L and an emission controller 402L. The second driver circuitry may, for example, include a scan driver 404R and an emission controller 402R. Operating the plurality of display pixel rows such as pixel rows 208 using the first driver circuitry disposed on the first side of each row and the second driver circuitry on the opposing second side of each row may be referred to as operating the plurality of pixel rows in a normal (or full power) operating mode.

At block 902, the first driver circuitry on the first side of each row is disabled. Disabling the first driver circuitry on the first side of each row may include providing a disable signal along a control line such as one of control lines 500 of FIG. 5 or 502L of FIG. 6 or 7.

At block 904, the plurality of display pixel rows 208 are operated using the second driver circuitry (e.g., scan driver 404R and emission controller 402R) on the second side of each row, while the first driver circuitry (e.g., scan driver 404L and emission controller 402L) is disabled.

At block 906, the first driver circuitry on the first side of each row is enabled. Enabling the first driver circuitry on the first side of each row may include providing an enable signal along a control line such as one of control lines 500 of FIG. 5 or 500L of FIG. 6 or 7.

At block 908, the second driver circuitry on the second side of each row is disabled. Disabling the second driver circuitry on the second side of each row may include providing a disable signal along a control line such as control line 500R of FIG. 6 or 7.

At block 910, plurality of display pixel rows are operated using the first driver circuitry (e.g., scan driver 404L and emission controller 402L) on the first side of each row, while the second driver circuitry (e.g., scan driver 404R and emission controller 402R) is disabled.

In the example of FIG. 9, alternating operation of the GIP circuitry on opposing sides of the display pixel rows, for a reduced-power mode of operation, is described in connection with blocks 902 to 910. As indicated, the display can be returned to a normal operating mode following the operations of block 910. It should also be appreciated that the display can be returned to the normal operating mode before all of the operations of blocks 902 to 910 have been performed and, in some scenarios, the operations of blocks 902 and 904 or 908 and 910 can be performed without performing the other of blocks 902 and 904 or 908 and 910. It should also be appreciated that an interleaved operation of GIP circuitry 206L and 206R may also, or alternatively, be performed. In an interleaved operation, enable/disable signals may be provided such that one row is driven by a left side scan driver and the next row is driven by a right side scan driver (for example). Interleaved driving of display pixels 204 may provide a balanced reliability performance for the circuitry on both sides and any luminance uniformity issues that could be introduced by single-side driving can be averaged out to reduce or eliminate any visible effect on the display.

Although the examples of FIGS. 4-9 describe GIP control circuitry that includes both a scan driver and an emission controller on both sides of the active area of the display (e.g., on both sides of each pixel row), this is merely illustrative. In accordance with other aspects of the subject disclosure, a display may be provided with GIP control circuitry that includes only one of a scan driver and an emission controller on a given side of a pixel row. In this way, the size of the inactive area of the display can be reduced.

Figure 10:
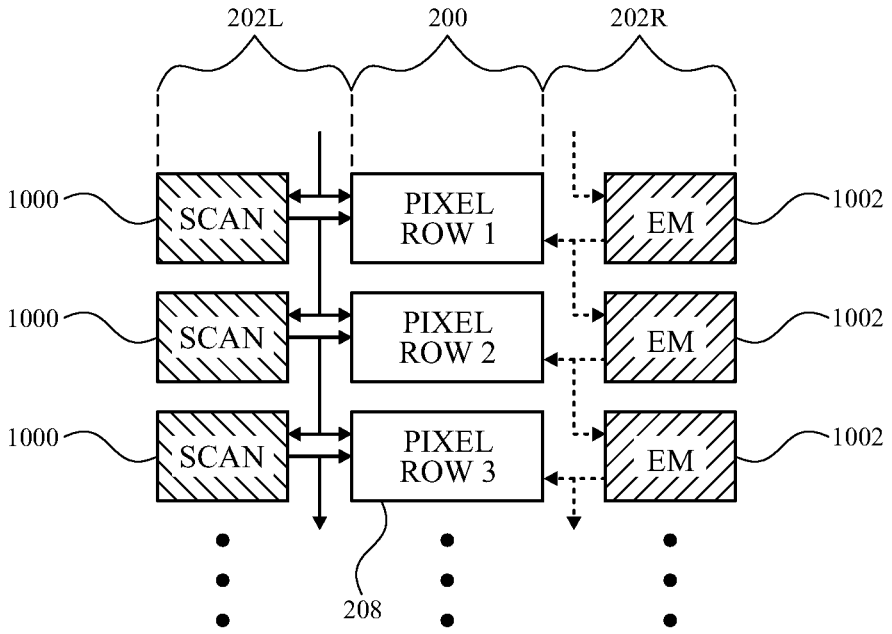
FIG. 10 illustrates a schematic diagram of single-sided control circuitry for pixel rows of an electronic device display in accordance with various aspects of the subject technology.

For example, FIG. 10 shows an example of display circuitry that includes a scan driver 1000 for each pixel row 208 and an emission controller 1002 for each pixel row 208, where the scan drivers 1000 are disposed on a first side of the pixel rows (e.g., in a first inactive area 202L on a first side of the active area 200) and the emission controllers 1002 are formed on an opposing second side of the pixel rows (e.g., in a second inactive area 202R on a second side of the active area 200). However, if care is not taken, driving all of the pixel rows 208 with scan drivers 1000 on a single side as in the arrangement of FIG. 10, can result in a potentially visible gradient across the display.

Figure 11:
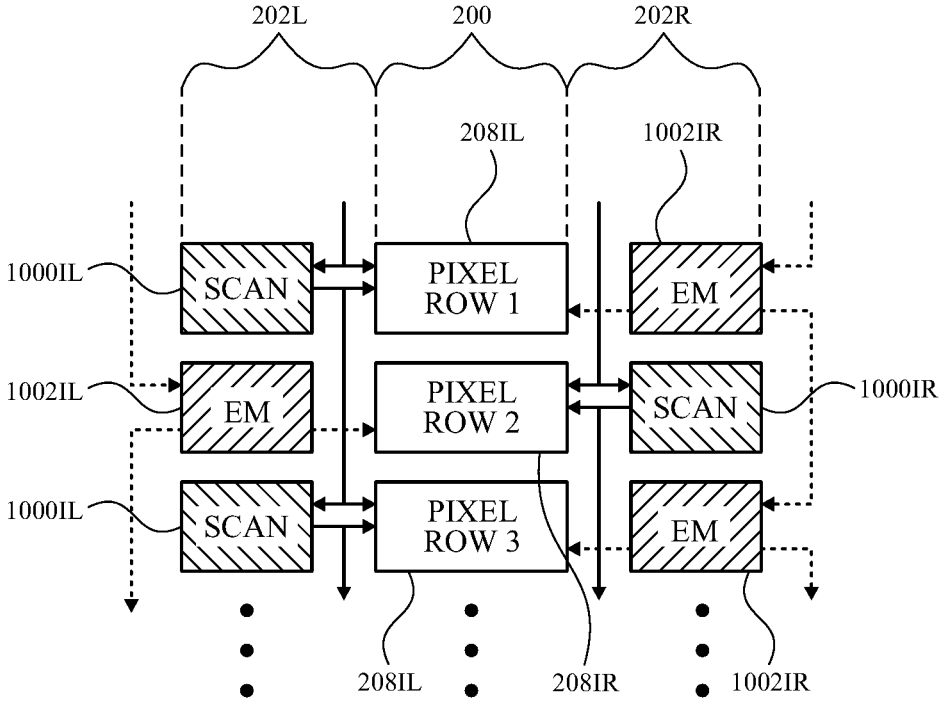
FIG. 11 illustrates a schematic diagram of interleaved control circuitry for pixel rows of an electronic device display in accordance with various aspects of the subject technology.

In accordance with some aspects of the subject disclosure, interleaved single-sided GIP circuitry is provided. FIG. 11 shows an example of interleaved single-sided GIP circuitry for display 110.

In the example of FIG. 11, a first set of pixel rows 208IL (e.g., a subset of the pixel rows of an array of display pixels) has scan drivers 1000IL on the left side of the pixel rows and a second set of pixel rows 208IR (e.g., a different subset of the pixel rows of the same array of display pixels) has scan drivers 1000IR on the right side of the pixel rows. The first set of pixel rows 208IL has emission controllers 1002IR on the right side of the pixel rows and the second set of pixel rows 208IR has emission controllers 1002IL on the left side of the pixel rows. In the example of FIG. 11, the first set of pixel rows 208IL are interleaved with the second set of pixel rows 208IR on a row-by-row basis (e.g., at least some of pixel rows 208IL are disposed between a pair of adjacent pixel rows 208IR and at least some of pixel rows 208IR are disposed between a pair of adjacent pixel rows 208IL). However, this is merely illustrative. In other implementations, pairs of pixel rows 208IL may be interleaved with pairs of pixel rows 208IR or other interleaving arrangements (e.g., interleaved groups of three, four, or more than four rows or an irregular interleaving of the pixel rows) may be provided.

Figure 12:
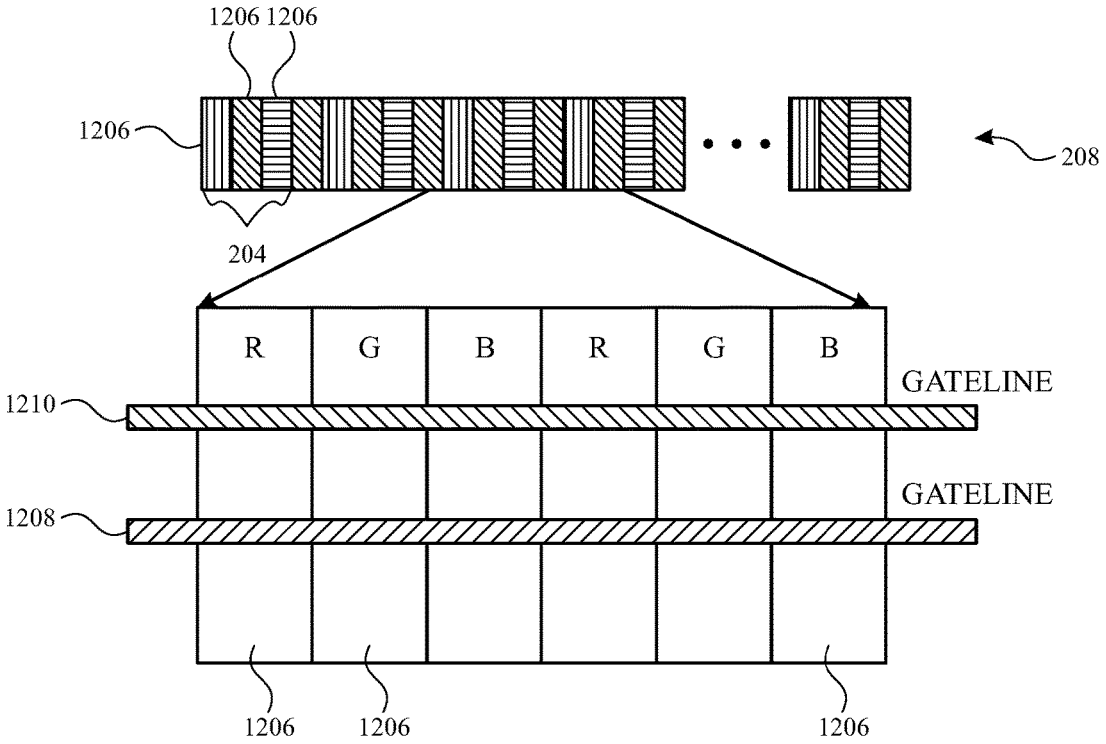
FIG. 12 illustrates a schematic diagram of gatelines for display pixels in accordance with various aspects of the subject technology.

FIG. 12 shows a schematic diagram of a pixel row 208 in accordance with various aspects of the subject disclosure. In the example of FIG. 12, each pixel 204 in each pixel row 208 includes multiple colored sub-pixels 1206. The expanded view of sub-pixels 1206 shows, schematically, how multiple gatelines 1208 and 1210 can be provided across each pixel row (e.g., multiple gatelines embedded one and/or within, and vertically spaced apart within, the display substrate). Gatelines 1208 and 1210 are used to provide scan or gate signals from scan drivers 404, 404L, 404R, 1000, 1000IL, or 1000IR to pixels 204 of an associated pixel row. In the arrangements of FIGS. 10 and 11 (as examples), gatelines 1208 and 1210 may be coupled together to provide a reduced-resistance pathway for the scan signals from a scan driver 1000IL or 1000IR on a single side of each pixel row.

Figure 13:
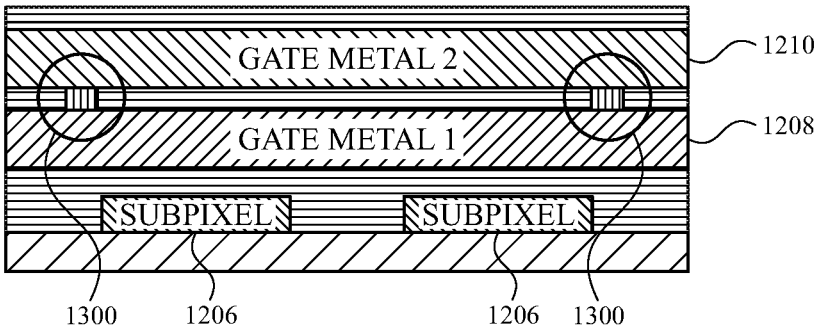
FIG. 13 illustrates a schematic cross-sectional side view of a portion of a display having coupled gatelines in accordance with various aspects of the subject technology.
Figure 14:
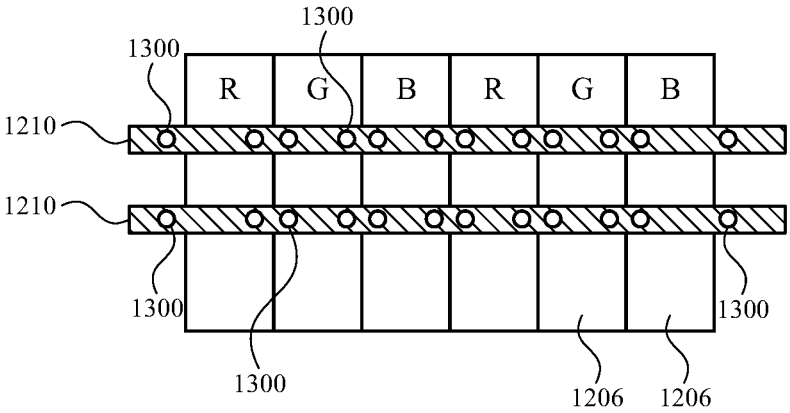
FIG. 14 illustrates a schematic diagram of a portion of a display having gatelines coupled by vias disposed between sub-pixels of a pixel array in accordance with various aspects of the subject technology.
Figure 15:
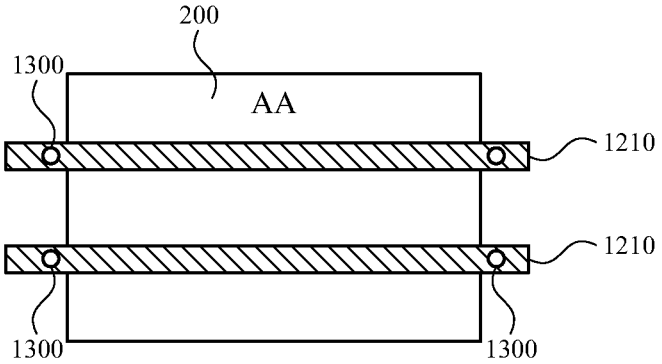
FIG. 15 illustrates a schematic diagram of a portion of a display having gatelines coupled by vias disposed at the edges of a pixel array in accordance with various aspects of the subject technology.

For example, FIG. 13 shows a schematic cross-sectional view of a portion of display 110 in which vias 1300 are provided between gatelines 1208 and 1210. As shown in FIGS. 13 and 14, vias 1300 may be provided within the active area of the pixel array (e.g., between sub-pixels 1206). However, in some arrangements, vias 1300 may be provided outside the active area 200 of the array as shown in FIG. 15.

Figure 16:
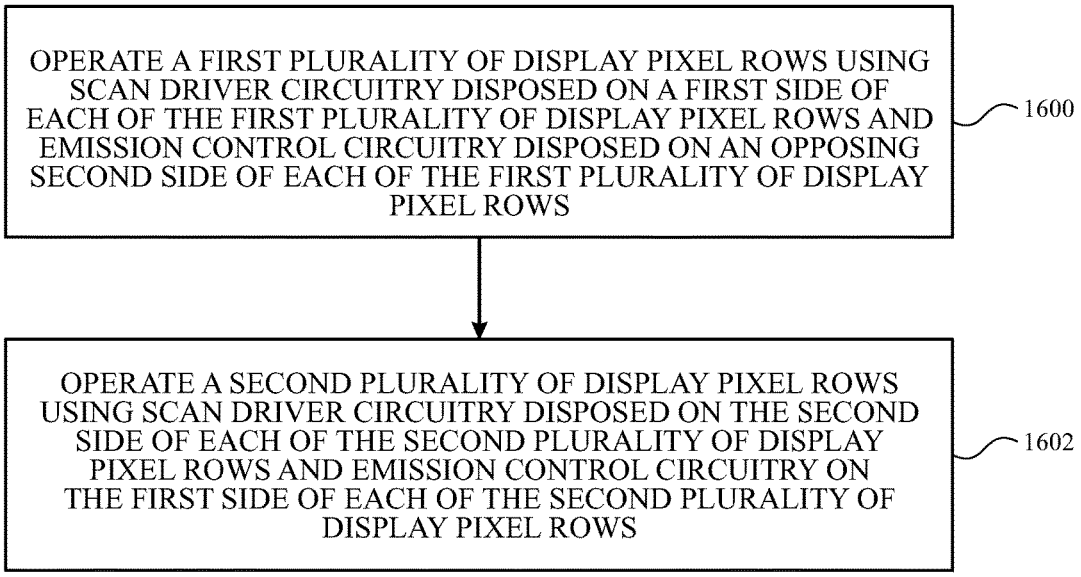
FIG. 16 illustrates a flow chart of an example process for operation of an electronic device display with interleaved control circuitry in accordance with various aspects of the subject technology.

FIG. 16 depicts a flow diagram of an example process for operating a display such as an AMOLED display with GIP in accordance with various aspects of the subject technology. For explanatory purposes, the example process of FIG. 16 is described herein with reference to the components of FIGS. 1-3 and 10-15. Further for explanatory purposes, the blocks of the example process of FIG. 16 are described herein as occurring in series, or linearly. However, multiple blocks of the example process of FIG. 16 may occur in parallel. In addition, the blocks of the example process of FIG. 16 need not be performed in the order shown and/or one or more of the blocks of the example process of FIG. 16 need not be performed.

In the depicted example flow diagram, at block 1600, a first plurality of display pixel rows (e.g., pixel rows 208IL of FIG. 11) is operated using scan driver circuitry (e.g., scan driver circuitry 1000IL) disposed on a first side of each of the first plurality of display pixel rows (e.g., in inactive area 202L) and emission control circuitry (e.g., emission control circuitry 1002IR) disposed on an opposing second side of each of the first plurality of display pixel rows (e.g., in inactive area 202R).

At block 1602, a second plurality of display pixel rows (e.g., a plurality of pixels rows such as pixels rows 208IR that are interleaved with the first plurality of pixel rows) are operated using scan driver circuitry (e.g., scan driver circuitry 1000IR) disposed on the second side of each of the second plurality of display pixel rows (e.g., in inactive area 202R) and emission control circuitry (e.g., emission control circuitry 10021L) on the first side of each of the second plurality of display pixel rows (e.g., in inactive area 202L).

In accordance with various aspects of the subject disclosure, an electronic device having a display is provided, the display including an array of display pixels arranged in pixel rows and pixel columns. The display also includes a first set of scan drivers each associated with one of the pixel rows and all disposed on a first side of the array. The display also includes a second set of scan drivers each associated with one of the pixel rows and all disposed on a second side of the array. The display also includes a control line coupled to the first set of scan drivers and arranged to provide an enable/disable signal to enable or disable the first set of scan drivers.

In accordance with other aspects of the subject disclosure, an electronic device having a display is provided, the display including an array of display pixels arranged in pixel rows and pixel columns. The display also includes a first set of scan drivers each associated with one of a subset of the pixel rows and all disposed on a first side of the array. The display also includes a first set of emission controllers each associated with one of the subset of the pixel rows and all disposed on a second side of the array. The display also includes a second set of scan drivers each associated with one of a different subset of the pixel rows and all disposed on the second side of the array. The display also includes a second set of emission controllers each associated with one of the different subset of the pixel rows and all disposed on the first side of the array.

In accordance with other aspects of the subject disclosure, a method of operating an electronic device with a display is provided, the method including operating a plurality of display pixel rows using first driver circuitry disposed on a first side of each row and second driver circuitry on an opposing second side of each row. The method also includes disabling the first driver circuitry on the first side of each row. The method also includes operating the plurality of display pixel rows using the second driver circuitry on the second side of each row, while the first driver circuitry is disabled.

In accordance with other aspects of the subject disclosure, a method of operating an electronic device with a display is provided, the method including operating a first plurality of display pixel rows using scan driver circuitry disposed on a first side of each of the first plurality of display pixel rows and emission control circuitry disposed on an opposing second side of each of the first plurality of display pixel rows. The method also includes operating a second plurality of display pixel rows using scan driver circuitry disposed on the second side of each of the second plurality of display pixel rows and emission control circuitry disposed on the first side of each of the second plurality of display pixel rows.

Various functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD- R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "processor", and "memory" all refer to electronic or other technological devices. These terms exclude people or groups of people. For the purposes of the specification, the terms "display" or "displaying" means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device as described herein for displaying information to the user and a keyboard and a pointing device, such as a mouse or a trackball, by which the user can provide input to the computer. Other kinds of devices can be used to provide for interaction with a user as well; for example, feedback provided to the user can be any form of sensory feedback, such as visual feedback, auditory feedback, or tactile feedback; and input from the user can be received in any form, including acoustic, speech, or tactile input.

Many of the above-described features and applications are implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a stand alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Some of the blocks may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. An electronic device having a display, the display comprising:

an array of display pixels arranged in pixel rows and pixel columns;

a first set of scan drivers, each associated with one of the pixel rows and all disposed on a first side of the array;

a second set of scan drivers, each associated with the one of the pixel rows and all disposed on a second side of the array such that each of the one of the pixel rows is associated with one of the first set of scan drivers and one of the second set of scan drivers;

a control line coupled to the first set of scan drivers and arranged to provide an enable/disable signal to enable or disable the first set of scan drivers;

a first set of emission controllers, each associated with one of the pixel rows and all disposed on the first side of the array;

a second set of emission controllers, each associated with one of the pixel rows and all disposed on the second side of the array;

wherein the first set of scan drivers and the second set of emission controllers are interleaved on the first side of the array;

wherein the second set of scan drivers and the first set of emission controllers are interleaved on the second side of the array.

2. The electronic device of claim 1, wherein, when the enable/disable signal is a disable signal that disables the first set of scan drivers, the second set of scan drivers is configured to operate all of the display pixels in all of the pixel rows.

3. The electronic device of claim 1, wherein when the enable/disable signal is a enable signal that enables the first set of scan drivers, the first set of scan drivers and the second set of scan drivers are configured to cooperate to drive all of the display pixels in all of the pixel rows.

4. The electronic device of claim 1, wherein each of the scan drivers in the first set of scan drivers includes an output line and an associated switch on the output line, the switch operable based on the enable/disable signal from the control line.

5. The electronic device of claim 1, wherein each of the scan drivers in the first set of scan drivers includes a plurality of internal transistors operable based on the enable/disable signal from the control line.

6. The electronic device of claim 1, wherein the control line is a first control line, the enable/disable signal is a first enable/disable signal, and the display further comprises a second control line coupled to the second set of scan drivers and arranged to provide a second enable/disable signal to enable or disable the second set of scan drivers.

7. The electronic device of claim 6, wherein, when the first enable/disable signal is a disable signal that disables the first set of scan drivers, the second set of scan drivers is configured to operate all of the display pixels in all of the pixel rows.

8. The electronic device of claim 7, wherein, when the second enable/disable signal is a disable signal that disables the second set of scan drivers, the first set of scan drivers is configured to operate all of the display pixels in all of the pixel rows.

9. The electronic device of claim 8, wherein, when the first enable/disable signal is a enable signal that enables the first set of scan drivers and the second enable/disable signal is a enable signal that enables the second set of scan drivers, the first set of scan drivers and the second set of scan drivers are configured to cooperate to drive all of the display pixels in all of the pixel rows.

10. The electronic device of claim 1, wherein the display pixels, the first set of scan drivers, and the second set of scan drivers are formed from thin-film transistor components on a common substrate.

11. The electronic device of claim 1, wherein the display pixels comprise organic light-emitting diode display pixels.

12. An electronic device having a display, the display comprising:

an array of display pixels arranged in pixel rows and pixel columns;

a first set of scan drivers, each associated with one of a subset of the pixel rows and all disposed on a first side of the array;

a first set of emission controllers each associated with one of the subset of the pixel rows and all disposed on a second side of the array;

a second set of scan drivers each associated with one of a different subset of the pixel rows and all disposed on the second side of the array;

a second set of emission controllers each associated with one of the different subset of the pixel rows and all disposed on the first side of the array;

wherein the first set of scan drivers and second set of emission controllers are interleaved on the first side of the array;

wherein the second set of scan drivers and first set of emission controllers are interleaved on the second side of the array.

13. The electronic device of claim 12, wherein at least one of the scan drivers of the first set of scan drivers is disposed adjacent to two of the emission controllers of the second set of emission controllers.

14. The electronic device of claim 12, wherein pairs of the first set of scan drivers are interleaved with pairs of the second set of emission controllers on the first side of the array.

15. The electronic device of claim 12, wherein the display pixels, the first set of scan drivers, the second set of scan drivers, the first set of emission controllers, and the second set of emission controllers are formed from thin-film transistor components on a common substrate.

16. The electronic device of claim 15, wherein the display pixels comprise organic light-emitting diode display pixels.

17. A method of operating an electronic device with a display, the method comprising:

operating a plurality of display pixel rows using first driver circuitry disposed on a first side of each row and second driver circuitry on an opposing second side of each row;

disabling the first driver circuitry on the first side of each row; and operating the plurality of display pixel rows using the second driver circuitry on the second side of each row, while the first driver circuitry is disabled;

wherein the first set of scan driver circuitry and a second set of emission control circuitry are interleaved on the first side of the display pixel rows;

wherein the second set of scan driver circuitry and a first set of emission control circuitry are interleaved on the second side of the display pixel rows.

18. The method of claim 17, further comprising:

enabling the first driver circuitry on the first side of each row;

disabling the second driver circuitry on the second side of each row; and operating the plurality of display pixel rows using the first driver circuitry on the first side of each row, while the second driver circuitry is disabled.

19. The method of claim 18, wherein the display pixels comprise organic light-emitting diode display pixels.

20. A method of operating an electronic device with a display, the method comprising:

operating a first plurality of display pixel rows using first scan driver circuitry disposed on a first side of each of the first plurality of display pixel rows and first emission control circuitry disposed on an opposing second side of each of the first plurality of display pixel rows; and operating a second plurality of display pixel rows using second scan driver circuitry disposed on the second side of each of the second plurality of display pixel rows and second emission control circuitry disposed on the first side of each of the second plurality of display pixel rows;

wherein the first set of scan driver circuitry and second set of emission control circuitry are interleaved on the first side of the display pixel rows;

wherein the second set of scan driver circuitry and first set of emission control circuitry are interleaved on the second side of the display pixel rows.

21. The method of claim 20, wherein the display pixels comprise organic light-emitting diode display pixels.

* * * * *